US007004258B2

(12) United States Patent
Farris

(10) Patent No.: US 7,004,258 B2
(45) Date of Patent: Feb. 28, 2006

(54) METHOD AND APPARATUS FOR ENHANCING OIL AND GAS FLOW IN A WELL

(76) Inventor: Sam Farris, 129 Briarwood St., Oklahoma City, OK (US) 73160

( * ) Notice: Subject to any disclaimer, the term of this patent is extended or adjusted under 35 U.S.C. 154(b) by 80 days.

(21) Appl. No.: 10/753,292

(22) Filed: Jan. 8, 2004

(65) Prior Publication Data

US 2005/0150658 A1 Jul. 14, 2005

Related U.S. Application Data

(60) Provisional application No. 60/462,837, filed on Apr. 16, 2003.

(51) Int. Cl.
*E21B 43/16* (2006.01)

(52) U.S. Cl. ..... 166/304; 166/312; 166/53; 166/305.1; 166/310

(58) Field of Classification Search ..... 166/53, 166/304, 312, 90.1, 305.1, 310
See application file for complete search history.

(56) References Cited

U.S. PATENT DOCUMENTS 3,412,798 A * 11/1968 Gregston ..... 417/56
5,758,725 A 6/1998 Streetman
2005/0022994 A1 * 2/2005 Wilson ..... 166/305.1

* cited by examiner

*Primary Examiner*—William Neuder
(74) *Attorney, Agent, or Firm*—R. William Graham

(57) ABSTRACT

An apparatus for increasing oil and gas recovery includes a delivery mechanism for automatically introducing a flow enhancing substance into a plunger of an oil or gas well and method.

9 Claims, 3 Drawing Sheets

METHOD AND APPARATUS FOR ENHANCING OIL AND GAS FLOW IN A WELL

This application claims priority from U.S. Provisional Application 60/462,837 filed Apr. 16, 2003.

BACKGROUND OF THE INVENTION

1. Field of the Invention

The present invention relates to a method and apparatus for increasing oil and gas recovery, and more particularly, but not by way of limitation, to a use of an oil and gas flow enhancing substance and plunger used to deliver the substance into the bottom of the well.

2. Related Art

In the recovery of oil from oil-bearing reservoirs, it is often possible to recover only a portion of the oil contained in the underground formation by the so-called primary recovery methods which utilize the natural forces present in the reservoir. Thus, a variety of enhanced recovery techniques, so-called secondary or tertiary recovery have been employed in order to increase the recovery of oil from subterranean reservoirs.

Chemical activated oil and gas flow enhancing liquids and sticks, such as soaps, are commonly known to reduce scale, paraffin and the viscosity of the fluids in the well and thus increase production of oil and gas recovery. Enhanced recovery techniques presently use a pump truck to pump a slurry mix either "in liquid form" of soap into the oil well either at the well head or through a special inner tubing which extends to the bottom of the hole or "in solid form" by dropping a soap stick into the well tubing.

These techniques have proved somewhat effective in enhancing oil recovery, but each has drawbacks. The liquid soaps require the use of additional equipment such as pump trucks to effectuate delivery of the soaps as well as building inner tubing to deliver the soap where the soap is most needed, i.e., at the bottom of the well. Delivery using such methods is not economical or practical due to continuous manual intervention, additional equipment and costs associated therewith.

Soap sticks are commonly used, but lack effectiveness as the soap sticks dissolve either too slowly upon reaching the well bottom or too quickly prior to reaching the well bottom. The length of time it takes for the stick to reach the bottom of the well depends upon well depth, viscosity of fluid, and the reactivity of the chemical stick to fluid environments as well as internal chemical release and aerodynamics of the stick shape. Due to the chemical nature of these chemical activated oil and gas flow enhancing sticks, they have a relatively limited mass or density advantage in the mass and density compared to the fluids in which they are placed and thus are limited in the rate in which they fall to the bottom of the well. In other words, by adding compositions to the sticks to increase their mass and density to decrease their time of decent, the reactivity of the stick is negatively impacted. One attempt to solve the problem employs the use of a plunger having a soap stick attached thereto. While this has provided an improvement, there remains a need for a more economical and effective method of enhancing oil recovery.

SUMMARY OF THE INVENTION

An object is to improve secondary oil and gas recovery using a novel method and apparatus.

Another object is to increase oil and gas production in an automated manner.

Accordingly, the present invention is directed to an apparatus for increasing oil and gas recovery in a well by enhancing oil and gas flow therein. The apparatus includes a delivery mechanism which has chamber and valve mechanism for automatically delivering a flow enhancing substance to a head of the well and further has a plunger which includes a storage compartment with a valve for automatically receiving the flow enhancing substance from the delivery mechanism at the well head and releasing the flow enhancing substance upon reaching a lower portion of the well.

The method of the present invention includes deploying a plunger in a well capable of automatically releasing an amount of flow enhancing substance in a lower portion of a well and automatically delivering an amount of flow enhancing substance to the plunger within the well.

By so providing, the present invention enables oil and gas flow enhancing material delivery in an improved automated manner with minimal cost and modification to existing equipment. In doing so, improved oil and gas recovery is obtained.

Other objects and advantages will be readily apparent to those skilled in the art upon viewing the drawings and reading the detailed description hereafter.

DETAILED DESCRIPTION OF THE PREFERRED EMBODIMENT

Figure 1B:
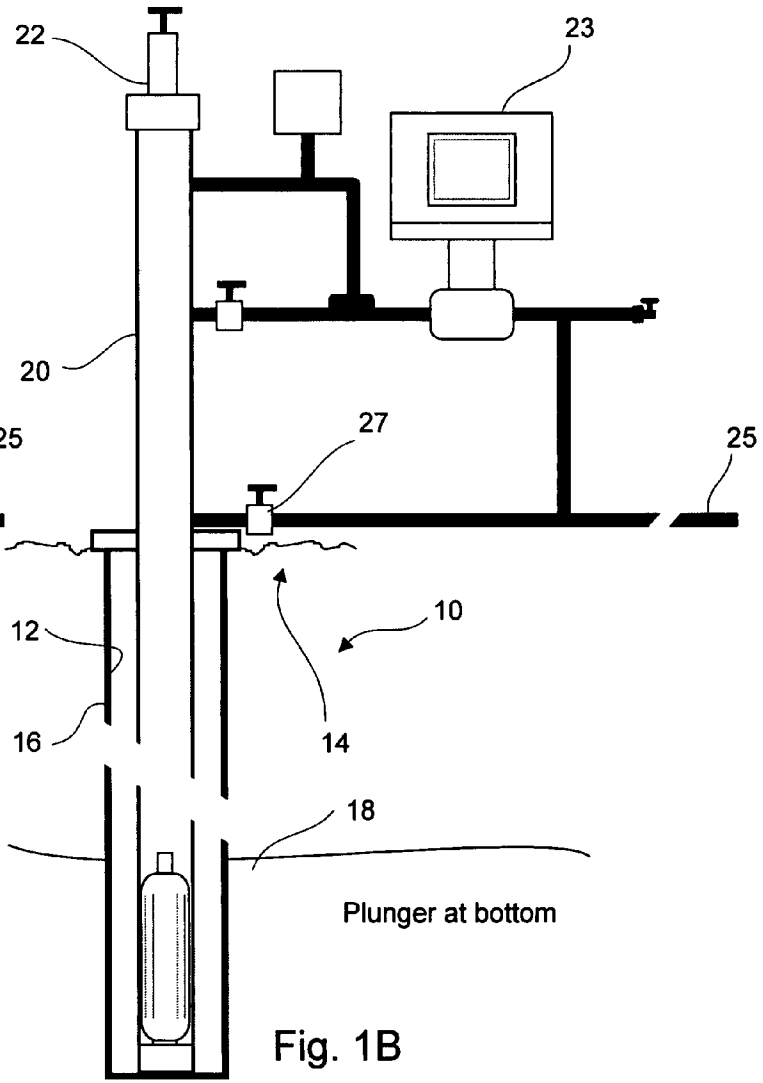
FIG. 1B is a longitudinal schematic of well having an automated delivery mechanism and plunger of the present invention therein in another mode.
Figure 1A:
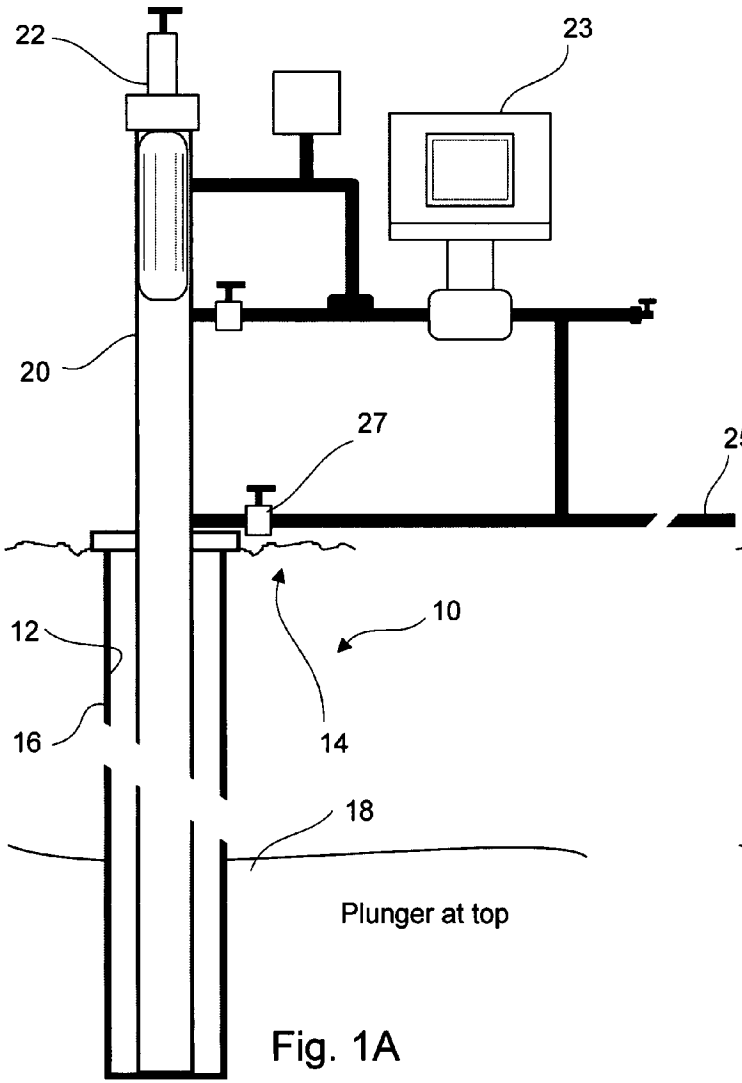
FIG. 1A is a longitudinal schematic of well having an automated delivery mechanism and plunger of the present invention therein in one mode.
Figure 2D:
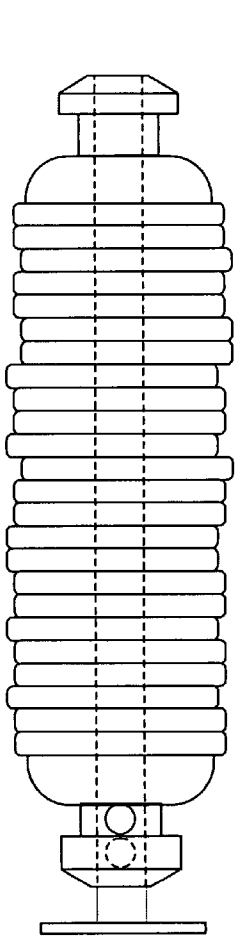
FIG. 2D is a cross section of yet another embodiment of a plunger which can be employed in FIG. 1.
Figure 2C:
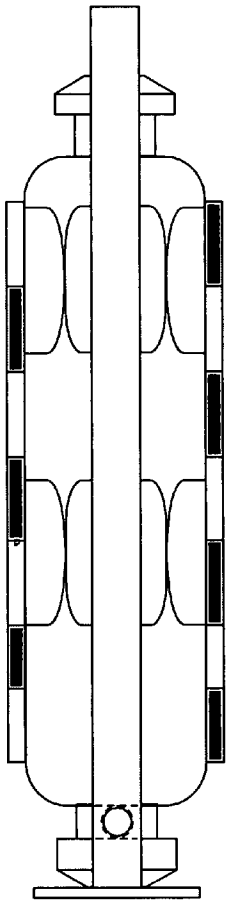
FIG. 2C is a cross section of the plunger in FIG. 2B showing the valve therein open.
Figure 2B:
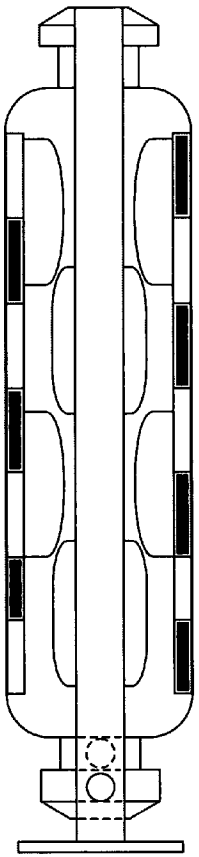
FIG. 2B is a cross section of another embodiment of a plunger which can be employed in FIG. 1 showing a valve therein closed.
Figure 2A:
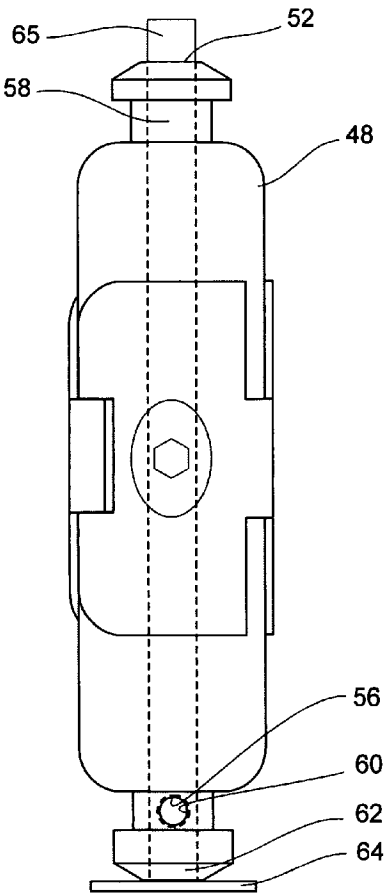
FIG. 2A is a cross section of an embodiment of a plunger which can be employed in FIG. 1.
Figure 3:
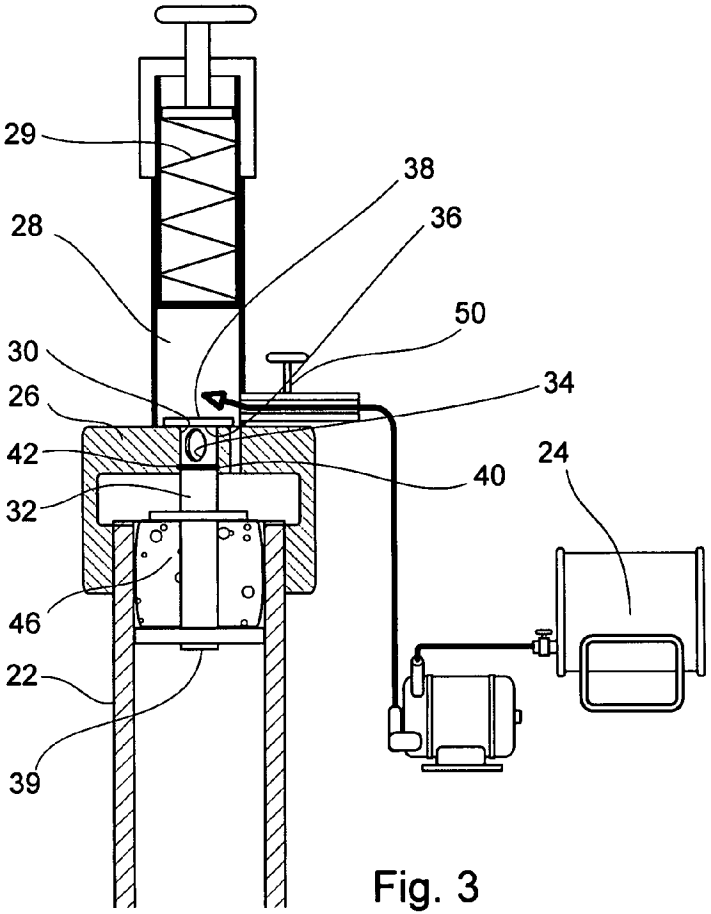
FIG. 3 is a schematic showing one mode of operation of the present invention showing a chamber on a modified well cap being filled with chemical.
Figure 4:
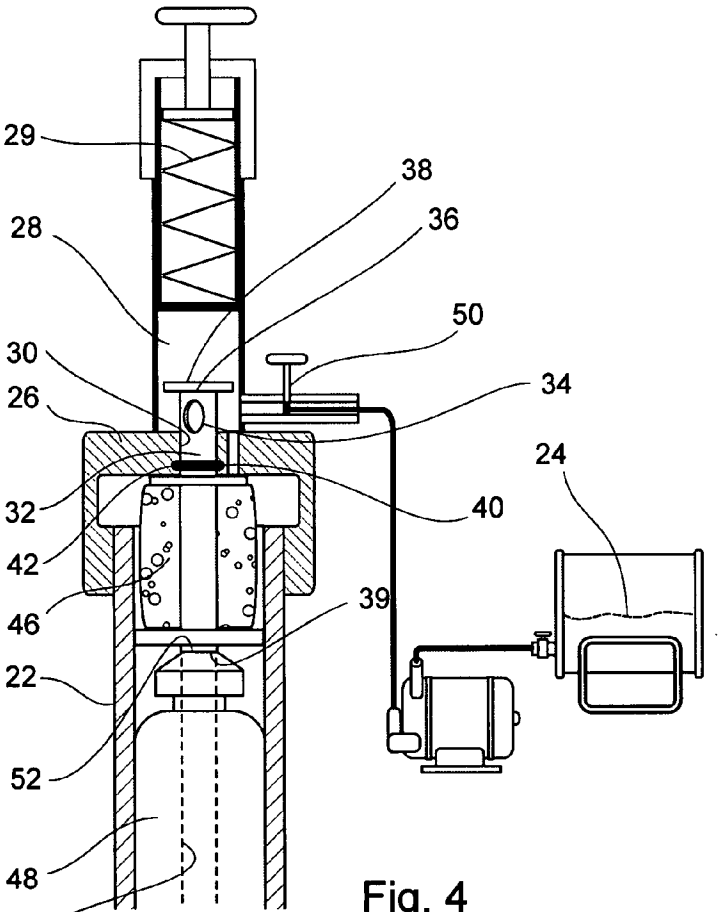
FIG. 4 is a schematic showing another mode of operation of the present invention showing the delivery of chemical from the chamber to the plunger.

Referring to the drawings, a well 10 having a well bore surface 12 drilled into the earth 14. Typical well string casing 16 exists within the well bore surface 12 and extends into the earth 14 to a gas and/or oil zone 18. A tubing string 20 is operably installed within the string casing 16 through which the gas and oil flow. Lubricator piping 22 is connected to the top of the tubing string 20.

A controller 23 is operably connected to the lubricator piping 22 and sales flow line 25. The controller 23 senses the pressure in the well 10 and can shut in the well 10 through an operable connection to a flow control valve 27.

An oil and gas flow enhancing substance 24 resides in a supply tank or other suitable container which can preferably be located adjacent the well 10. On top of the lubricator piping 22 is a modified cap 26. The modified cap 26 has a chamber 28 formed thereon with an open surface 30 therethrough for communicating between the lubricator piping 22 and chamber 28. An adjustable pressure bellows 29 is operably disposed in the chamber 28.

A hollow sliding valve member 32 is operably disposed through the open surface 30 in the cap 26 and includes a side port 34 in end 36 which has a stop head 38 thereon. Valve member 32 has its other end 39 open. An O-ring 40 is disposed in a channel 42 of the open surface 30 to provide a seal between the valve member 32 and the open surface 30. A controlled valve 50 connects the chamber 28 and the supply tank of flow enhancing substance 24 and is controlled by controller 23 to enable a controlled amount of the substance 24 to enter the chamber 28 when the port 34 is closed thus not enabling communication with the lubricator piping 22.

The end 39 extends through a bumper 46, which can be a polymer or spring element within the lubricator piping 22, to absorb the impact of a plunger 48. The plunger 48 can employ a similar type to that known in the art, such as an interlocking expandable, wobble washer, brush plunger, etc, with the modification provided by the present invention, i.e., the plunger 48 include an inlet 52 through which an amount of the substance 24 is received into an inner open surface 54, and an outlet valve 56 to release the amount of the substance 24 in a lower portion of the well 10. More particularly, the plunger 48 can include hollow sliding valve member 58 which operably extends through the inner open surface 54 and includes a side port 60 on end 62. Valve member 58 has a stop head 64 thereon and has its other end 65 open. The valve outlet 56 and side port 60 slide in and out of communication as follows.

When the well is shut in by the controller 23, pressure builds in the well 10 which causes the plunger 48 to rise and contact the bumper 46 and causes the sliding valve member 58 to move in a manner which places the outlet 56 and port 60 out of communication. The impact of the plunger 48 also impacts the end 39 of the sliding valve member 32 which opens the side port 34 and permits the substance 24 within the chamber 28 to flow into the plunger 48 via sliding valve member 58.

The oil and gas flow enhancing substance 24 can be for example microorganisms, inhibitors, corrosion preventatives, paraffin solvents, foaming agents and/or gas expansion agents. The form of the substance 24 should be such to enable practice of the invention, which can preferably be liquid, or other gels or solids.

The well 10 is equipped with the controller 23 to open and shut the well fluid flow. The plunger 48 drops to the bottom of the well 10 or to a point where the plunger 48 impacts a fluid level. At such point, the impact moves the stop head 64 into contact with the plunger 48 thereby causing alignment of the port 60 with outlet 56 and the release of the substance 24 at the lower portion of the well to begin chemically reacting releasing the oil and/or gas flow enhancing agent at the most desired point, the oil and/or gas zone.

Once flow in the well diminishes below a predetermined flow rate as determined by the controller 23, the controller 23 shuts then the valve 27 and the cycle is repeated. While the preferred embodiment of the present invention is illustrated and described, it is to be understood that this is capable of variations and modifications and therefore, the applicant does not wish to be limited to the precise details set forth, but desires to avail himself of such changes and alterations as fall within the purview of the following claims.

What is claimed is:

1. An apparatus for increasing oil and gas recovery in a well by enhancing oil and gas flow therein, wherein the well has a well bore surface and well string casing therein extending into an oil and gas zone, a tubing string operably installed within the string casing through which the oil and gas flow and a sales flow line connected to the tubing, including:

means for automatically delivering a flow enhancing substance to a head of the well wherein said delivering means includes lubricator piping connected to the tubing string and a controller having a sensor operably interconnected to said lubricator piping and a supply container containing said flow enhancing substance and is further operably connected to the sales flow line, wherein said controller is programmed to sense when well flow diminishes below a predetermined flow rate and is equipped to shut in the well through a flow control valve operably connected to the sales flow line; and a plunger operably disposed in a manner to move within the tubing string and said lubricating piping and having means for automatically receiving said flow enhancing substance from said delivering means at the well head and releasing said flow enhancing substance upon reaching a lower portion of the well.

2. The apparatus of claim 1, wherein said delivery means further includes a first hollow sliding valve member operably disposed in said lubricating piping and includes a side port in a first end which has a stop head thereon and an open second end, means for sealing communication between said side port of said first end and said open second end, a controlled valve disposed between said side port and said supply container and controlled by said controller to enable a controlled amount of said flow enhancing substance to enter the lubricating when said side port is closed, said second end contactable by said plunger to cause said side port to place in an open position to permit said amount of substance to be received into a second hollow sliding valve member operably extending through and contained by said plunger, wherein said second hollow sliding valve member includes a side port on a first end and an open second end for contact with said second end of said first hollow sliding member, the plunger further having a valve outlet disposed at a second end thereof and communicates with said side port of said first end as said second hollow valve member slides back and forth through said plunger.

3. The apparatus of claim 1 wherein said substance includes at least one of scale inhibitors, corrosion preventatives, paraffin solvents, foaming agents and gas expansion agents.

4. The apparatus of claim 1, wherein said substance includes a combination of at least two of a group including scale inhibitors, corrosion preventatives, paraffin solvents, foaming agents and gas expansion agents.

5. A method for enhancing oil and gas flow in a well wherein the well has a well bore surface and well string casing therein extending into an oil and gas zone, a tubing string operably installed within the string casing through which the oil and gas flow and a sales flow line connected to the tubing, which includes the steps of:

employing delivering means which includes lubricator piping connected to the tubing string and a controller operably interconnected to said lubricator piping and a supply container containing said flow enhancing substance and is further operably connected to the sales flow line, wherein said controller is programmed to sense when well flow diminishes below a predetermined flow rate and is equipped to shut in the well through a flow control valve operably connected to the sales flow line;

deploying a plunger in a well operably disposed in a manner to move within the tubing string and said lubricating piping and capable of automatically releasing an amount of flow enhancing substance in a lower portion of a well; and automatically delivering an amount of flow enhancing substance to said plunger within the well.

6. The method of claim 5, which further includes the step of periodically shutting in the well to enable said automatic delivery of said amount of flow enhancing substance to said plunger.

7. The method of claim 6, which further includes the step of periodically opening the well flow after said shutting in step to enable said plunger to deliver of said amount of flow enhancing substance.

8. The method of claim 7, wherein said opening step occurs subsequent to sensing a predetermined pressure in the well.

9. The method of claim 5, wherein said substance includes at least one of scale inhibitors, corrosion preventatives, paraffin solvents, foaming agents and gas expansion agents.

* * * * *